United States Patent [19]

Drozdowski

[11] Patent Number: 4,821,328

[45] Date of Patent: Apr. 11, 1989

[54] SOUND REPRODUCING SYSTEM WITH HALL EFFECT MOTIONAL FEEDBACK

[76] Inventor: Stanislaw Drozdowski, 3220 Stream Side Rd., Apt. 16, Raleigh, N.C. 27613

[21] Appl. No.: 922,851

[22] Filed: Oct. 24, 1986

[51] Int. Cl.[4] ..... H04R 3/00

[52] U.S. Cl. ..... 381/96; 381/59

[58] Field of Search ..... 381/55, 96, 171, 59, 381/199, 201; 338/32 H; 324/174

[56] References Cited

U.S. PATENT DOCUMENTS

| | | | |
|---|---|---|---|
| 3,636,767 | 1/1972 | Duffy | 324/174 |
| 3,845,444 | 10/1974 | Masuda et al. | 338/32 H |
| 3,997,739 | 12/1976 | Kishikawa et al. | 381/201 |
| 4,163,119 | 7/1979 | Baba et al. | 381/55 |
| 4,176,305 | 11/1979 | Cuno | 381/121 |
| 4,480,155 | 10/1984 | Winey | 381/201 |
| 4,550,430 | 10/1985 | Meyers | 381/96 |
| 4,598,178 | 7/1986 | Rollins | 381/96 |
| 4,609,784 | 9/1986 | Miller | 381/96 |

FOREIGN PATENT DOCUMENTS

| | | | |
|---|---|---|---|
| 57-184397 | 11/1982 | Japan | 381/96 |
| 58-207800 | 12/1983 | Japan | 381/171 |

*Primary Examiner*—Forester W. Isen

[57] ABSTRACT

A sound reproducing system with motional feedback utilizes a Hall generator, mechanically driven by the sound generating member of the system and disposed in an inhomogenous magnetic field, as a source of the feedback signal. It is a feature of the present invention that the feedback signal closely follows the movements of the sound generating member irrespective of the acoustic frequency.

2 Claims, 2 Drawing Sheets

SOUND REPRODUCING SYSTEM WITH HALL EFFECT MOTIONAL FEEDBACK

CROSS-REFERENCES TO RELATED PRIOR ART

U.S. Pats.: U.S. Pat. No. 2,194,175, 3/1940, K. Wilhelm, U.S. Pat. No. 2,860,183, 11/1958, I. W. Conrad, U.S. Pat. No. 3,057,961, 10/1962, W. M. Turner, U.S. Pat. No. 3,334,184, 8/1967, S. H. De Koning, U.S. Pat. No. 3,798,374, 3/1974, S. T. Meyers, U.S. Pat. No. 3,176,305, 11/1979, H. H. Cuno, U.S. Pat. No. 4,256,923, 3/1981, S. T. Meyers.

BACKGROUND OF THE INVENTION

1. Field of the Invention

The invention relates generally to sound reproducing systems and in particular to such systems which include motion sensing means in a feedback path.

2. Description of the Prior Art

There are numerous solutions of the problem of motional feedback in sound reproducing systems for improving frequency and transient responses as well as reducing distortions and loudspeaker dimensions. Common idea of existing solutions consists in transforming the motion of the loudspeaker sound generating member, most frequently a cone, into an electrical signal and applying this signal degeneratively into the feedback loop, forcing the loudspeaker to respond linearly to the input acoustic signal.

Such prior art sound reproducing systems, utilizing an auxiliary coil or a light beam and a photocell as a feedback signal source, are cited in U.S. Pat. No. 2,194,175, issued to Wilhelm.

Conrad, in his U.S. Pat. No. 2,860,183, describes sound reproducing systems deriving the feedback signal from an auxiliary winding on the voice coil bobbin, a piezoelectric transducer or a movable magnetic diaphragm.

De Koning in U.S. Pat. No. 3,334,184, issued to him, describes motional feedback by means of a piezoelectric transducer of acceleration.

U.S. Pat. No. 3,057,961, issued to Turner, discloses self-correcting sound reproducing apparatus with capacitive, mechano-electrical feedback transducer.

Method of transformation of loudspeaker cone motion into an electrical signal by means of a magnetoresistive transducer has been disclosed by Cuno in his U.S. Pat. No. 4,176,305.

Further, Meyers in his U.S. Patents No. 3,798,374 and No. 4,256,923 discloses motional feedback by means of a sensing coil interacting with a magnetic field of a permanent magnet or interacting with a stray field of a loudspeaker magnet.

Among disadvantages of the prior art systems are: necessity of adding substantial mass to the moving system of the loudspeaker, electrical interference from the electromagnetic system of the associated loudspeaker and, what is most important, they are sensitive to first or even second derivative of the cone displacement with respect to time rather than to the cone displacement as such. In other words, the prior art motional transducers detect the speed or even the acceleration of the sound generating member, what renders them frequency dependent, necessitates application of complex equalizer circuits and at very low acoustic frequencies makes them virtually useless due to substantial decrease of the feedback signal.

SUMMARY OF THE INVENTION

It is an object of this invention to provide light and simple source of motional feedback signal closely following the movements of the sound generating member, irrespective of acoustic signal frequency.

In practical realization of this objective, the well known principle of Hall effect displacement transducer has been applied for sensing instantaneous values of the cone displacement.

In general, the Hall effect displacement transducer consists of a Hall generator and a reference magnet producing inhomogenous magnetic field in which the Hall generator is disposed. When the Hall generator is supplied by constant current, it will generate voltage, known as Hall voltage, proportional to ambient magnetic field. So, for given magnetic field distribution, the relative position of the Hall generator with respect to the reference magnet will be determined by the value of the corresponding Hall voltage.

According to the present invention, the motional feedback in a sound reproducing system is accomplished by means of mechanical linkage of the Hall generator to the sound generating member of the system in such way which enables reciprocating motion of the Hall generator within the reference magnet structure. Voltage derived from the Hall generator, in this arrangement, is functionally related to the instantaneous value of the displacement of the sound generating member. Thus, this voltage may be used as a motional feedback signal.

BRIEF DESCRIPTION OF THE DRAWING

The objectives, advantages and features of the present invention will be better appreciated by a consideration of the following detailed description with the accompanying drawing in which.

DESCRIPTION OF THE PREFERRED EMBODIMENT

The simplest practical embodiment according to the present invention consists in employing the existing loudspeaker main magnet structure as a reference magnet. In this embodiment, the Hall generator linked to the moving system of the loudspeaker is disposed in the field of the loudspeaker magnet, preferably where the inhomogenity of the field is highest.

However, more advanced embodiments will employ separate reference magnet structures so arranged that magnetic field, as sensed by the Hall generator, will be linear with respect to displacement, with zero value at the loudspeaker rest position. In such arrangements the Hall voltage wave-form is congruent with the displacement versus time characteristic of the motion of the sound generating member. Thus, in this arrangement Hall voltage provides the most desired form of feedback signal.

Figure 1:
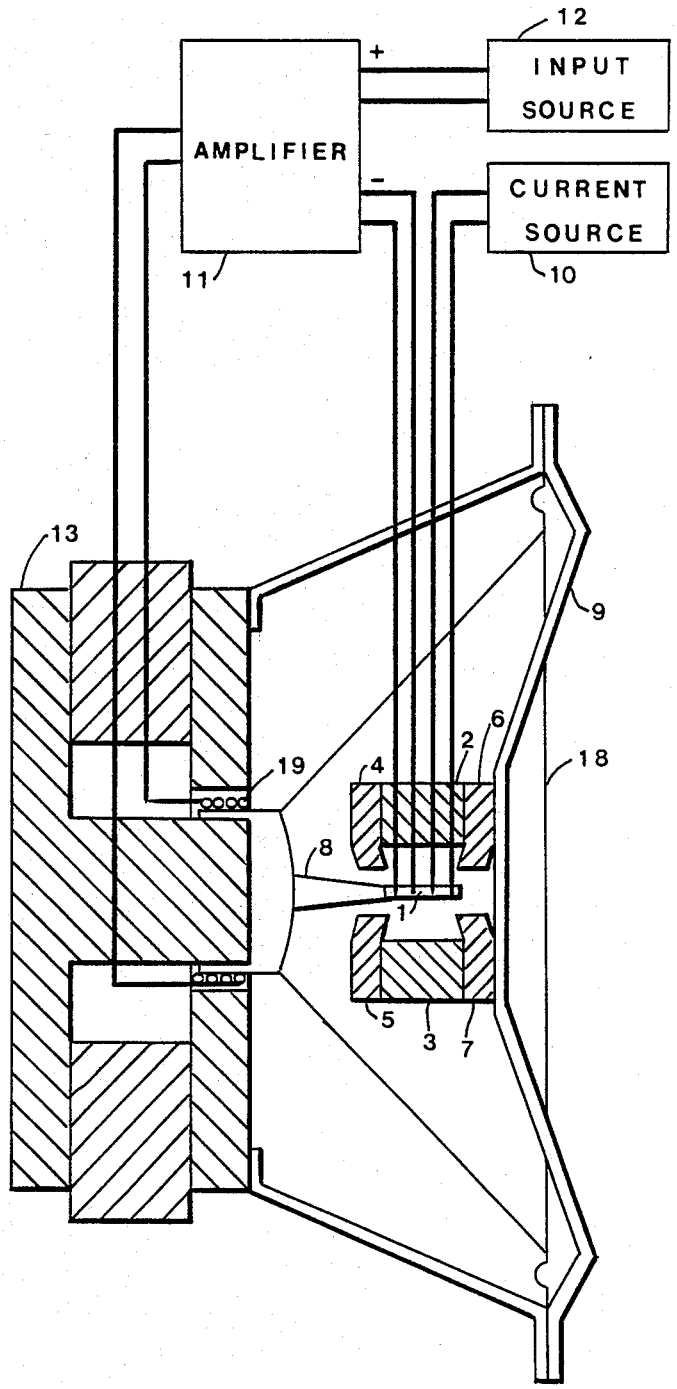
FIG. 1 illustrates a sound reproducing system according to the present invention with two gap reference magnet structure.

FIG. 1 illustrates sound reproducing system with motional feedback utilizing Hall generator 1 mechanically driven by the loudspeaker sound generating member, in this case cone 18, by means of link 8. Hall generator 1 is disposed in the space between gaps of a reference magnet structure. The reference magnet structure consists of magnets 2 and 3, and four pole pieces 4, 5, 6 and 7, forming first and second gap. Polarities of magnet 2 and magnet 3 are so matched that magnetic field in the first gap, between pole pieces 4 and 5, is in opposite direction to the magnetic field in the second gap, between pole pieces 6 and 7. When the loudspeaker coil 19 is energized by an acoustic signal, it will vibrate together with cone 18, putting Hall generator 1 into reciprocating motion between said two gaps. When Hall generator 1 is supplied by current source 10, the instantaneous Hall voltage value will equal zero in mid-position between the said gaps and will reach maximum of one polarity in the first gap and maximum of the opposite polarity in the second gap. Length of link 8 and dimensions of support 9 are so matched that zero Hall voltage value falls at loudspeaker rest position. Using methods known in the prior art, the magnetic field versus displacement characteristic may be arbitrarily shaped by proper shaping the pole pieces. Thus, most preferred, linear characteristic is easily attainable. The gaps of the reference magnet structure are so spaced that the travel of Hall generator 1 will not exceed the linearity range of the magnetic field versus displacement characteristic. Voltage derived from Hall generator 1 is fed back to negative input of amplifier 11. Positive input of amplifier 11 is fed by acoustic signal from input source 12.

Figure 2:
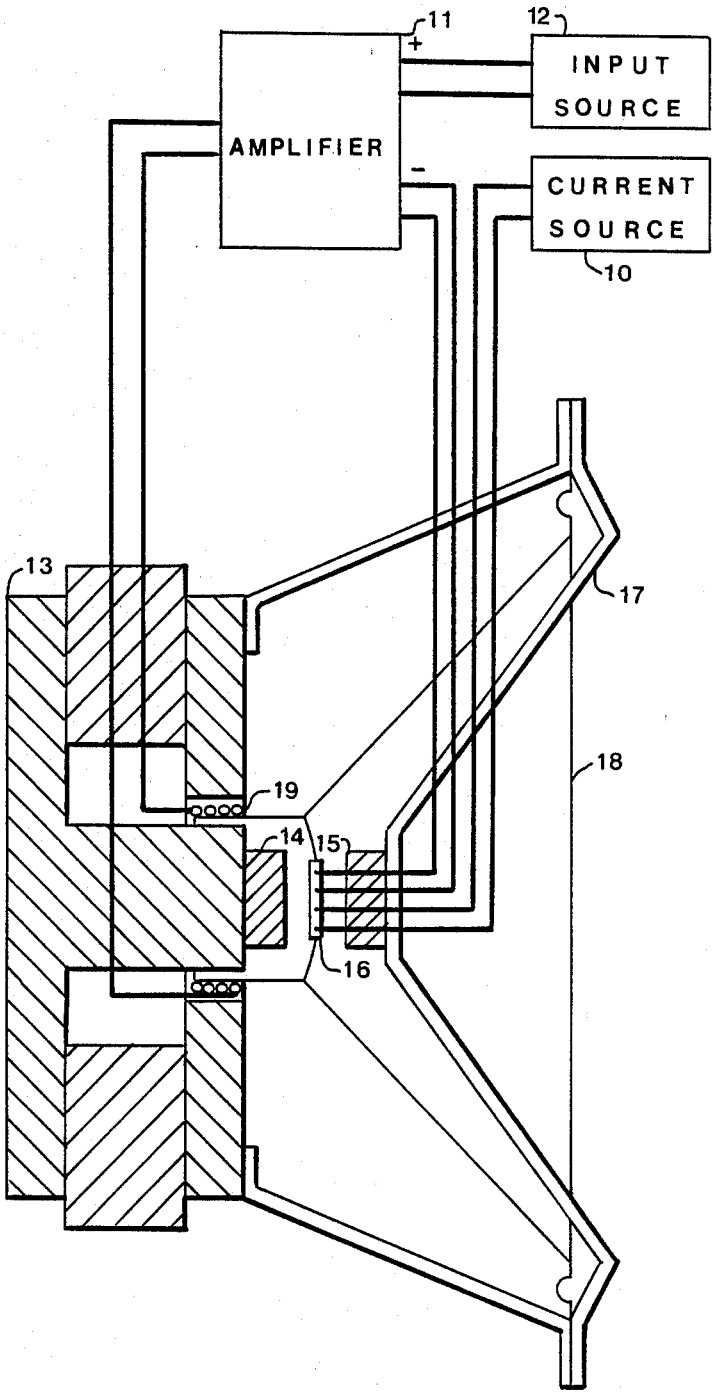
FIG. 2 illustrates a sound reproducing system according to the present invention with single gap reference magnet structure.

FIG. 2 illustrates second embodiment of cone movement sensing means according to the present invention. In this case the reference magnet structure consists of two magnets 14 and 15 with their homonymous poles opposing each other. Hall generator 16 reciprocates in the gap between said magnets along the axis connecting the magnetic poles of said magnets. Again, the proper shape of the magnet poles as well as dimensions of support 17 control the field distribution in the reference magnet structure of this embodiment so, the abovementioned condition concerning linearity and zero signal value at rest position is easily attainable. The Hall generator may be connected with the cone by means of a link or, what is an advantage of this embodiment, may be affixed directly to the cone. Magnet 14, as shown in FIG. 2, is attached directly to the main magnetic structure 13 of the loudspeaker but may be alternatively supported by a spacer, a bracket or similar means. Other elements of the embodiment: loudspeaker main magnetic structure 13, current source 10, amplifier 11, input source 12 as well as the electric circuitry are identical with those of the first embodiment.

When the loudspeaker proper, comprising main magnetic structure 13, is of conventional type, the cone movement sensing means according to the present invention and the feedback electric circuitry may be applied to existing loudspeakers as appliques.

The arrangements according to the present invention of sound reproducing systems with motional feedback utilizing Hall generators have been described in terms of specific embodiments, but it will be apparent to those skilled in the art that within the scope of the disclosed principle many modifications are possible, particularly concerning the way and place of the Hall generator linkage to the sound generating member and means of connecting the reference magnet to the loudspeaker structure. Furthermore, the present disclosure describes the motional feedback as applied to a dynamic loudspeaker with moving coil and with sound generating member in form of a cone, but it will be apparent again that motional feedback utilizing Hall generators may be applied to other types of loudspeakers.

I claim as my invention:

1. Means for sensing the motion of sound generating member of a sound reproducing system, wherein said means comprise:

at least one Hall generator, linked to and mechanically driven by said sound generating member;

a reference magnet structure, comprising two magnets, wherein said magnets form single gap between their homonymous poles, and wherein spatial relation of said reference magnet structure to said Hall generator results in said Hall generator reciprocating along the axis connecting said homonymous poles of said reference magnet structure;

a current source energizing said Hall generator; and an amplifier jointly responsive to an input signal and a feedback signal, derived from said Hall generator.

2. Means for sensing the motion of sound generating member of a sound reproducing system, wherein said means comprise:

at least one Hall generator, linked to and mechanically driven by said sound generating member;

a reference magnet structure, comprising two magnets, each of said magnets being provided with two pole pieces, and wherein said pole pieces form a magnetic field exhibiting two regions of opposite polarity linearily spaced along the path of movement of said Hall generator;

a current source energizing said Hall generator; and an amplifier jointly responsive to an input signal and a feedback signal derived from said Hall generator.

* * * * *